United States Patent [19]

Enderlin

[11] Patent Number: 5,014,380

[45] Date of Patent: May 14, 1991

[54] PROCESS AND INSTALLATION FOR HEAT TREATMENT OF TEXTILE THREADS

[75] Inventor: Robert Enderlin, Morschwiller-Le-Bas, France

[73] Assignee: Passap Knitting Machines, Inc., Salt Lake City, Utah

[21] Appl. No.: 416,315

[22] PCT Filed: Mar. 2, 1988

[86] PCT No.: PCT/FR88/00118

§ 371 Date: Aug. 15, 1989

§ 102(e) Date: Aug. 15, 1989

[87] PCT Pub. No.: WO88/06653

PCT Pub. Date: Sep. 7, 1988

[30] Foreign Application Priority Data

Mar. 6, 1987 [FR] France ..... 87 03222

[51] Int. Cl.[5] ..... D06B 3/04

[52] U.S. Cl. ..... 8/149.3; 68/5 E

[58] Field of Search ..... 68/5 D, 5 E; 28/281; 8/149.3

[56] References Cited

U.S. PATENT DOCUMENTS

| | | | |
|---|---|---|---|
| 3,067,602 | 12/1962 | Brunt | 68/5 E |
| 3,927,540 | 12/1975 | Tanaka et al. | 68/5 E |
| 4,571,765 | 2/1986 | Okada et al. | 68/5 E |
| 4,718,257 | 1/1988 | Reinehr et al. | 68/5 E X |

FOREIGN PATENT DOCUMENTS

| | | | |
|---|---|---|---|
| 2307202 | 11/1976 | France . | |
| 2453927 | 11/1980 | France | 68/5 E |
| 2453928 | 11/1980 | France | 68/5 E |
| 2478150 | 9/1981 | France | 68/5 E |
| 2596079 | 9/1987 | France | 68/5 E |
| 950349 | 2/1964 | United Kingdom . | |
| 2022158 | 12/1979 | United Kingdom . | |

*Primary Examiner*—Philip R. Coe

[57] ABSTRACT

Installation including a steaming chamber, a first, upstream cold chamber and a second, downstream cold chamber, with the length of the upstream cold chamber being at least equal to that of the downstream cold chamber. The upstream and downstream cold chambers may be connected by a pressure-equalized pipe. A fan may be provided to extract the stream at the top of the steaming chamber and reinject it, after reheating by a heating element, into a perforated steaming box from which jets of steam issue below the conveyor belt, which is also perforated. The upstream cold chamber and the steaming chamber may be provided with elements for creating an upstream or downstream temperature gradient to prevent the threads from being subjected to thermal shock during passage through the steaming chamber.

22 Claims, 6 Drawing Sheets

PROCESS AND INSTALLATION FOR HEAT TREATMENT OF TEXTILE THREADS

1. FIELD OF THE INVENTION

The present invention relates to a continuous heat treatment process for textile threads and more particularly thermofixation of these threads. The threads which are previously deposited on a conveyor belt, are passed through an installation having several consecutive chambers adjacent to one another of which at least one is a steaming chamber.

The invention likewise relates to a continuous heat treatment installation for textile threads, particularly the thermofixation of these threads. The installation includes several consecutive chambers adjacent to one another, of which at least one is a steaming chamber, and at least one conveyor belt on which these threads are deposited having a path which crosses the chambers.

2. SUMMARY OF THE BACKGROUND MATERIAL

The continuous thermofixation installations developed by applicant usually include an enclosure known as a steaming enclosure or thermofixation chamber, and two chambers known as cold chambers arranged on both sides of the thermofixation chamber with each being separated from the thermofixation chamber by an intermediate chamber. The steaming enclosure is generally filled with saturated pressurized steam, that is circulated across the belt and the threads carried thereon, with the temperature of the steaming chamber being maintained at a predetermined temperature, greater than 100° C. The upstream and downstream cold chambers are preferably connected between them by an appropriate conduit, to permit an equalization of the pressures, and are fed with pressurized air by a blower which permits the creation of a slight overpressure with respect to the average pressure prevailing inside the steaming enclosure. The presence of the cold chambers with overpressure and intermediate chambers furnished with lock chambers are provided with the aim of avoiding great losses of steam generated within the steaming enclosure, and thereby reduce energy consumption.

In the majority of known installations in service today, for example according to French Patent FR-A-2, 453, 927, the upstream cold chamber is relatively short and in principle does not have any particular function in the framework of the treatment process of the thread, of not to prevent, as much as possible, escape of steam, by virtue of the surrounding overpressure.

The average length of the upstream cold chamber is currently on the order of 0.5 meters. The downstream chamber currently has a length of 2 meters given that it plays a supplementary role with respect to that of the upstream chamber, i.e. that of ensuring a precooling of the threads at the outlet of the steaming enclosure. The evolution of the temperature in such a known installation is illustrated by FIG. 7 which will be described in detail below.

It has been observed that after a momentary stop of the conveyor belt carrying the threads, the material situated during this stop in a zone near the outlet of the upstream cold chamber or in the intermediate chamber, and that which is at this moment upstream from this zone, obtained different tinctorial affinities. In practice, this translates, after treatment, into lengths of thread in which the colorant has a concentration other than that on the rest of the thread, which results in the appearance of lines or bands which are lighter or darker through a cloth or a piece of fabric. This consequence constitutes, of course, a disadvantage since it results in a product having defects.

Analysis of the phenomenon has permitted the observation that during the stop of the conveyor belt of threads to be thermofixed, the heat present inside the steaming enclosure is diffused through the lock chamber delimiting the intermediate chamber and spreads progressively into the cold chamber. The result is a preheating of the threads situated in the outlet zone of the cold chamber or in the corresponding intermediate chamber, this preheating having the consequence of a modification in the structure of the fibers having been used for the fabrication of the thread, with this modification of structure leading to a modification in the tinctorial affinity. It has been deduced that the sudden passage of the threads from the upstream cold chamber towards the steaming enclosure caused for the thread a thermal shock which is more significant when the conveyor belt is in motion than when it remained stopped for some time, and that the difference between the thermal shocks sustained by the thread under normal transport conditions and after the stop are at the origin of these modifications of tinctorial affinity leading to defects in the products manufactured by means of these threads.

SUMMARY OF THE INVENTION

It is an object of the present invention to remedy the above-noted disadvantage by bringing to known installations various improvements making it possible to avoid that the different thermal shocks, sustained respectively during the continuous operation and at the stop of the conveyor belt, be at the origin of apparent defects in the products manufactured by means of the threads treated by the thermofixation installation.

To this end, the process according to the invention is characterized in that one causes a gradual increase in the temperature of the threads upstream and/or downstream from the inlet of the steaming chamber, so as to decrease the thermal shock sustained by the threads entering this chamber.

According to a first embodiment of this process, a gradient of positive temperature is produced in the direction of displacement of the conveyor belt, in an upstream cold chamber adjacent to the inlet of the steaming chamber.

According to a second embodiment of this process, the upstream cold chamber is subdivided into several compartments crossed successively by the threads and different temperature conditions are maintained in these different compartments.

According to a third embodiment of the process according to the invention, a positive temperature gradient is produced inside the steaming chamber in the direction of displacement of the conveyor belt.

In a preferred embodiment, a determined temperature gradient is imposed along at least one part of the path of the belt by maintaining, in several consecutive chambers or in consecutive compartments provided in several chambers, respective temperatures which are different and gradually graduated.

To end up with this result, at least in the last compartment preceding the steaming chamber, some air may be taken in the downstream upper part of this compartment to reinject it in the bottom of its upstream part. This air taken in the upper downstream zone is preferably heated or cooled by an exterior source before being reinjected in the bottom of the upstream part of the compartment concerned. Preferably, the air is heated by an input of steam or cooled by an input of cool air.

To create said temperature gradient in the steaming enclosure, one can preferably protect the threads arranged on the conveyor belt against a flow of heat conveying steam, in the inlet zone of the steaming enclosure.

In combination with this measure or independently, the temperature gradient may be created by reinjecting, in the central zone of said steaming enclosure, steam taken in the top of the downstream part of this chamber, so as to cause a mixing of this steam in said central zone.

The installation according to the invention is characterized in that it comprises means for creating a gradual increase in the temperature of the threads upstream and/or downstream from the inlet of the steaming chamber, so as to decrease the thermal shock sustained by the threads entering this chamber.

In an installation comprising two cold chambers arranged on both sides of the steaming chamber and two intermediate chambers located on the one hand between the upstream cold chamber and the steaming chamber and on the other hand between the steaming chamber and the downstream cold chamber, the upstream cold chamber has a length at least equal to that of the downstream cold chamber. Preferably, this upstream cold chamber comprises at least two partitioned compartments and the latter compartment, in the direction of the circulation of the conveyor belt, is preferably equipped with means to elevate the temperature of the surrounding air to a value greater than that of the other compartments.

The means for elevating the temperature in this latter compartment can preferably comprise a suctioning element to suction air in the top of the downstream part of this compartment and to discharge it in the bottom of its upstream part, as well as a heating element arranged to elevate the temperature of this air before its reinjection into the compartment.

In a particular embodiment, the upstream cold chamber can contain at least two compartments arranged consecutively along the conveyor belt and around the latter, each compartment being equipped with means to circulate a current of air, or air and steam, across the belt and the thread, with means to heat or cool this air, and control means to adjust the temperature and/or the air flow. Each of the compartments can preferably be constituted by housing incorporated in a respective closed circuit. On the other hand, the means for heating the air can comprise a device for injection of a measured quantity of steam in the air current. The means for cooling this air can likewise comprise a device for injection of a measured quantity of cold air.

The means for heating the air comprise preferably comprise at least one electrically resistant heating element arranged in the closed circuit.

According to a particularly advantageous embodiment, the upstream cold chamber contains a steam generating device situated outside of said housings, which comprise orifices for admission of steam.

According to one embodiment, the steaming chamber comprises in the zone near its inlet a tunnel positioned on the trajectory of the conveyor belt, this tunnel comprising walls designed to constitute a thermal screen for the transported thread.

The means for creating a temperature gradient in the steaming chamber may preferably comprise a suctioning element to take steam in the top of the downstream part of this chamber and reinject it in the bottom of a central zone, and a heating element arranged to elevate the temperature of this steam before its reinjection in this chamber.

To ensure the equilibrium of the pressures between the two cold chambers, the installation preferably comprises a first conduit arranged to connect these two chambers, this conduit being connected to a second feeding conduit connected to a pressurized air source, a second conduit being equipped with a valve controlled by a first regulator attached to at least two temperature probes arranged respectively in the two intermediate chambers, and to a pressure probe arranged in the steaming chamber. The first conduit preferably opens up in the upstream cold chamber within the compartment positioned farthest upstream. The steaming chamber preferably contains a temperature probe connected to a second regulator arranged to control a valve mounted on the steam feeding conduit of this steaming chamber, and the first and second regulators are preferably coupled between them.

Another embodiment of an installation according to the invention comprises a modular series of consecutive units each comprising a chamber furnished with mixing means to circulate air and/or steam in the chamber, and adjustment means to maintain a predetermined temperature in the chamber. Preferably, this installation comprises a centralized control, arranged to control the assembly of mixing means and adjustment means, and at least one of the units is arranged to contain the pressurized steam.

BRIEF DESCRIPTIONS OF THE DRAWINGS

The present invention will become clear with reference to the description of embodiments and the annexed drawings in which:

FIG. 1 shows schematically in longitudinal cross-section a first embodiment of the installation according to the invention, FIG. 2 shows a schematic view of a preferred embodiment of the upstream cold chamber, FIG. 3 shows a schematic view of a preferred embodiment of the steaming enclosure, FIG. 4 shows a schematic view in longitudinal cross-section of another embodiment of the upstream cold chamber, FIG. 5 is a transverse cross-sectional view following line V—V of FIG. 4, FIGS. 5A and 5B are views similar to FIG. 5 and show two alternative embodiments, FIG. 6 is a view analogous to FIG. 4, showing another alternative embodiment, FIG. 7 is a diagram showing the evolution of the temperature of the thread in a thermofixation installation comprising an upstream cold chamber according to the prior art, FIG. 8 is a diagram showing the evolution of the temperature of the thread in an installation comprising an upstream cold chamber according to FIG. 4, and FIG. 9 shows an elevated schematic view of an installation according to the invention, achieved in modular form, and a diagram of variation of the temperature T in this installation.

DETAILED DESCRIPTION OF THE EMBODIMENTS

Figure 1:
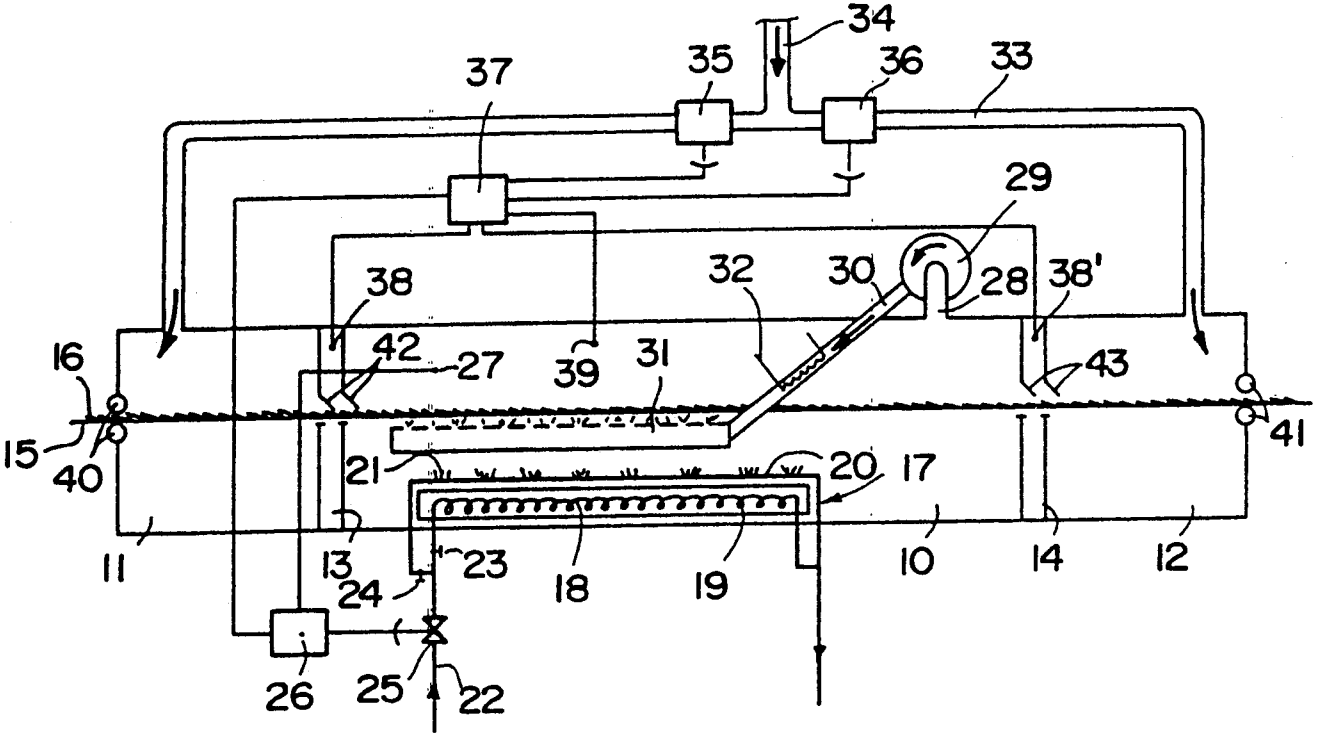

With reference to FIG. 1, the installation shown comprises a steaming chamber 10, an upstream cold chamber 11, a downstream cold chamber 12 and two intermediate chambers 13 and 14. In a known manner, a conveyor belt 15 successively crosses the upstream cold chamber 11, the intermediate chamber 13, the steaming chamber 10, the intermediate chamber 14 and the downstream cold chamber 12 and transports one or several threads 16 wound in superimposed spirals or coiled to ensure the thermofixation of the threads. The steaming chamber is joined to a steam generator 17 which can be constituted of a heating coil 18 conveying the steam and lodged within a vat 19 filled with water, or a perforated exhaust pipe 20 which liberates jets of steam 21 within the chamber or, as shown in FIG. 1, a combination of these two means. A feeding nozzle 22 common to these two circuits, which can be used separately by virtue of two valves 23 and 24, is equipped with a valve 25 controlled by a regulator 26 to which is connected a probe 27 to measure the temperature of the steam contained within the steaming chamber 10.

To ensure an efficient mixing of the steam within the steaming chamber, the latter is equipped with an outlet conduit 28 provided in the top of the enclosure 10 and attached to a suctioning element 29 arranged to discharge the steam taken in a conduit 30 to direct it towards a caisson 31, perforated in its upper surface, and positioned under the conveyor belt 15, itself perforated to permit a forced passage of the steam through the spirals of thread 16 arranged on the belt. A heating element 32 is mounted in the conduit 30 to elevate the temperature of the steam suctioned through the conduit 28. To make it possible to balance the pressures prevailing within the two cold chambers, a conduit 33 connects these two chambers. This conduit 33 is connected to a conduit 34 coupled to a source of compressed air, so as to propel the air under relatively high pressure into the two cold chambers 11 and 12 and to thereby create an overpressure, with respect to the pressure prevailing in the steaming chamber, to avoid escape of steam which would be too great. Two valves 35 and 36 are controlled by a regulator 37, coupled to two temperature probes 38 and 38' respectively, positioned within the intermediate chambers 13 and 14, and possibly to the regulator 26. A pressure sensor 39 lodged in the steaming chamber is connected to the regulator 37.

In a known manner, two presser rollers 40 define the inlet of the upstream cold chamber 11 and two presser rollers 41 define the outlet of the downstream cold chamber 12. Valves or flaps 42 ensure a relative sealing of the steaming chamber at its inlet and flaps 43 ensure a similar function at its outlet.

In known installations of this type, the upstream cold chamber is generally relatively small, on the order of 0.5 m, whereas the downstream cold chamber has a length which is substantially more significant which is usually on the order of 2 m. One of the improvements brought to these installations by the present invention consists of lengthening the upstream cold chamber, so that its length is at least equal to that of the downstream cold chamber, to thereby produce a gradient of temperature within this chamber to reduce in a fairly consistent manner the thermal shock sustained by the threads in the passage from the upstream cold chamber to the steaming chamber. This gradient of temperature can be obtained simply by adjusting, by the regulators and the valves controlled by these regulators, the pressures in the steaming chamber and the chambers positioned upstream, so as to allow a certain diffusion of the steam from the steaming enclosure towards the upstream cold chamber.

Figure 2:
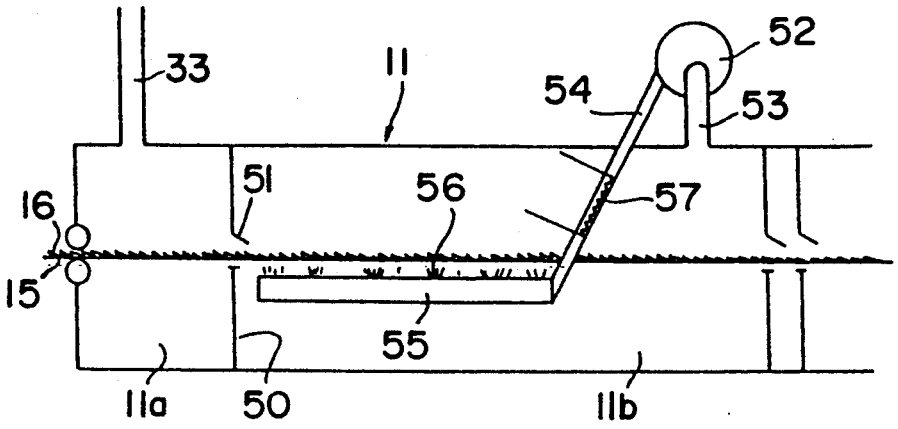

Such a control does not always permit a good command of the temperature gradient In practice, it is preferable to adjust this temperature more directly. FIG. 2 illustrates other means making it possible to create a temperature gradient in the upstream chamber 11. To this end, this chamber is divided in two compartments **11*a* and 11*b* separated by a partition 50 whose upper wall comprises a valve or flap 51 intended to reduce the diffusion of air from the compartment 11*b* towards compartment 11*a*. Conduit 33, ensuring the equilibrium of pressures between the upstream cold chamber, and the downstream cold chamber opens up into compartment 11*a*. Compartment 11*b* is equipped with a device for mixing the air including a ventilator 52 connected by means of a conduit 53 at the top of the downstream part of compartment 11*b*, a conduit 54 receiving air at the outlet of ventilator 52, this conduit 54 being connected to a caisson 55, perforated in its upper surface, which generates jets of air 56 intended to cross the conveyor belt 15 to ensure a preheating of the thread 16 deposited in flat spirals or in coils on this belt. Given that conduit 53 opens at the top of compartment 11*b* in its downstream part, i.e. its hottest part, this system makes it possible to ensure a preheating of the thread 16. This preheating effect can be reinforced by a heating element 57 mounted within conduit 54**, and designed to ensure a heating of the air conveyed by this conduit.

Figure 3:
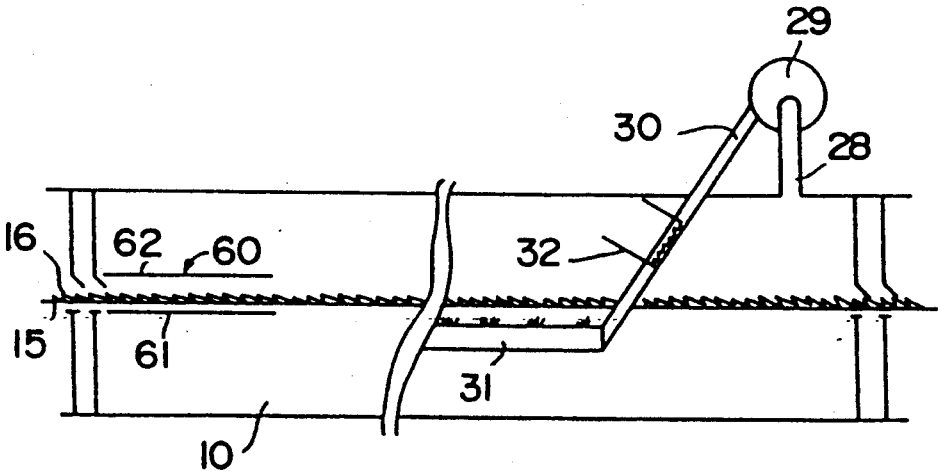

FIG. 3 illustrates in a more detailed manner the improvements brought to the equipment of the steaming chamber and intended to create a temperature gradient within this chamber. As mentioned previously, the upstream cold chamber is equipped with different means making it possible to achieve a progressive preheating of the threads 16 transported by the conveyor belt 15 so as to reduce the effects of the thermal shock sustained during the passage from this cold chamber where there usually prevails a temperature on the order of 60°–80° C., towards the steaming chamber where there is usually a temperature which is on the order of 132° C. when the threads are of polyamide and 145° C. when the threads are of polyester. The means equipping the upstream cold chamber now making it possible to end up at a temperature which remains on the order of 60°–80° C. at its upstream inlet and which goes up to 110° or 120° C. on the side of its downstream outlet. If no precaution is taken, there remains a jump on the order of 20°–40° C. during the passage of the threads in the steaming chamber 10. To reduce the effects of this jump, the steaming chamber has been equipped with a tunnel 60 positioned at its inlet, composed for example of a lower plate 61 positioned under the conveyor belt and an upper element 62 positioned above the layer of threads 16, to decrease the direct impact of the mixed steam in the steaming enclosure. In addition, the suctioning element 29 which takes the steam by a conduit 28 to discharge it in a perforated caisson 31 through a conduit 30 containing a heating element 32, has been displaced downstream so that the maximal mixing of the steam occurs rather towards the middle and towards the downstream end of this chamber. Thus the action exerted by the steam jets on the thread deposited on the conveyor belt remains small on the upstream side and increases progressively towards the middle of the treatment chamber.

Figure 4:
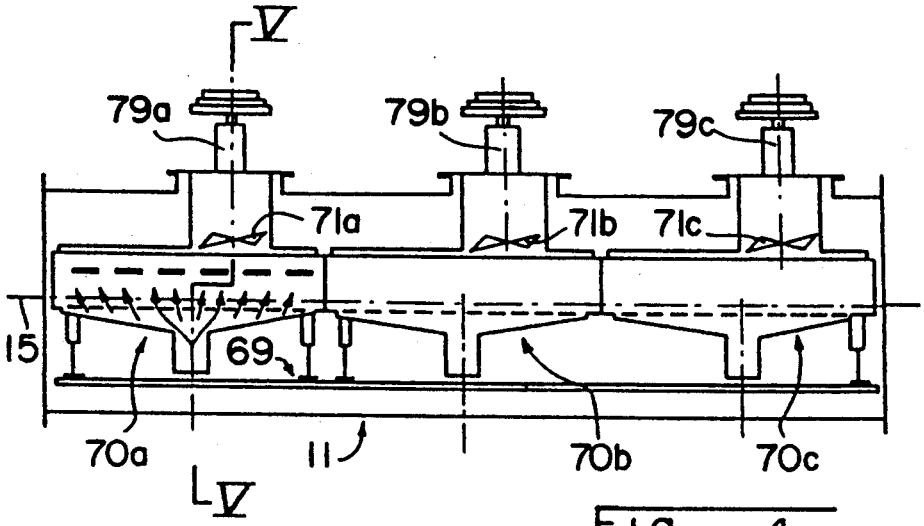
Figure 5:
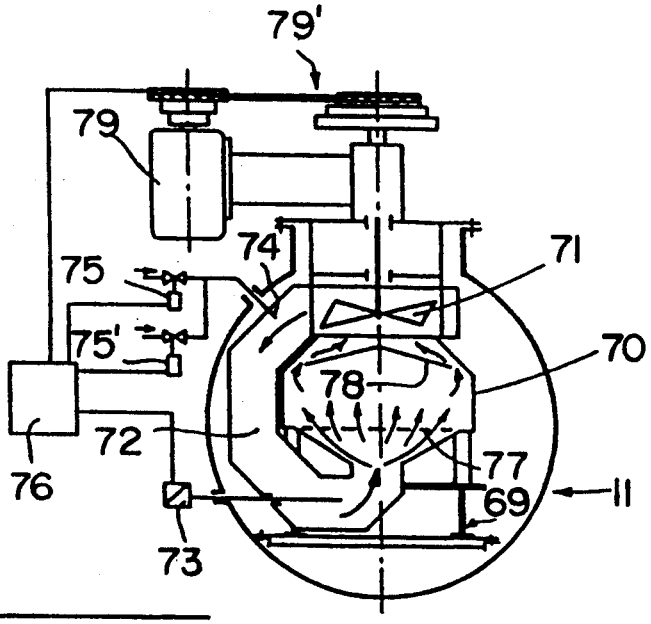

FIGS. 4 and 5 illustrate another embodiment of the upstream cold chamber 11, designed as a chamber for progressive preheating. The chamber encloses a frame 69 supporting, for example, three consecutive housings 70*a*, 70*b* and 70*c*, which are positioned consecutively along the conveyor belt 15 and which surround this belt and the threads that it transports. The respective elements of these three housings are similar and they bear the same reference numbers, with the signs a, b and c, respectively. As the figures show, each housing 70 is incorporated in a closed circuit for circulation of hot air or an air/steam mixture, each of these circuits comprising a ventilator 71 positioned above housing 70, a return conduit 72 connecting the ventilator 71 and the bottom of housing 70, a temperature probe 73, and a steam injection nozzle 74 or an air/steam mixture in conduit 72. The flow of steam is adjusted by an electrovalve 75 controlled by an adjustment device 76 so as to maintain a predetermined temperature of the air in the circuit. So as to also make it possible to cool this atmosphere, nozzle 74 is likewise connected to a source of compressed air, by means of an electrovalve 75' controlled by device 76. The air of the circuit is substantially at the same pressure as the rest of the interior of chamber 11 and, by circulating as the arrows indicate, it crosses from bottom to top a support grid 77, the belt and the thread, then it passes around a deflector 78 to be recovered by the ventilator 71. The latter is moved at an adjustable velocity controlled by device 76, for example by virtue of a motor 79 and a variable ratio transmission 79'.

Figure 5A:
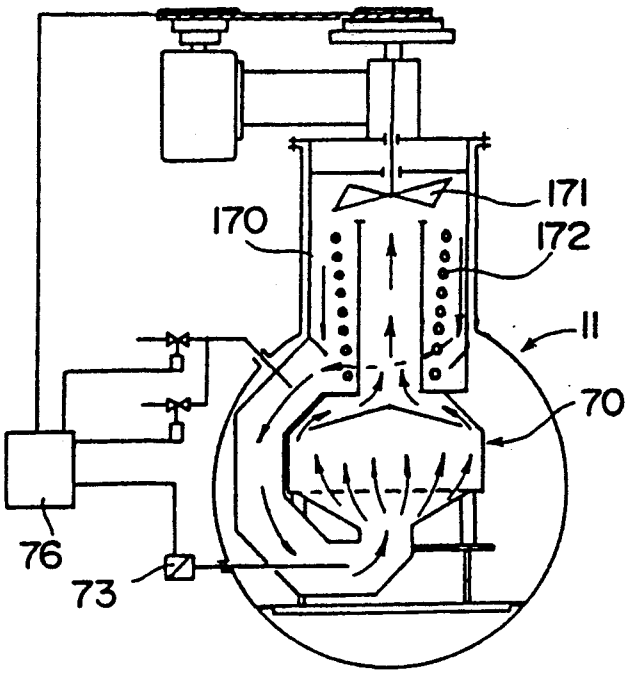
Figure 5B:
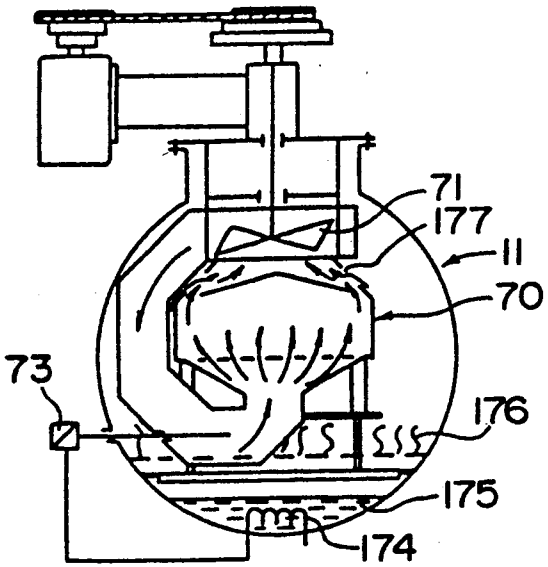

The control device 76 is arranged to maintain the predetermined respective values of the temperature and velocity of the air current in each of housings 70, this temperature and velocity being combined with the progression velocity of the thread such that the latter rises gradually in temperature in the successive housings 70 while going through the upstream cold chamber. If for whatever reason the belt must be stopped, the device 76 adjusts the temperature and velocity of the air current in an optimal manner to conserve in the thread a constant tinctorial affinity. In such a chamber, according to the products to be treated and the permanent or temporary conditions, one can work with the following parameters: number of preheating circuits put into service, pressure, flow and air temperature, flow and temperature of the injected steam FIGS. 5A and 5B are similar to FIG. 5 and illustrate two alternative embodiments of heating means making it possible to adjust the respective temperature of the air circuit of each of housings 70. In the case of FIG. 5A, housing 70 is elevated by a cylindrical part 170 which contains ventilator 171 and, downstream from the latter, a heating element 172 having electrical resistance which permits a quick and easy adjustment of the air temperature. In addition, this makes it possible to preheat the air before starting the phase of steam thermofixation, by treating the thread in chamber 11 either by hot air alone, or by superheated steam injected in the air circuit.

In the example of FIG. 5B, the bottom of the upstream cold chamber 11 contains a steam generator device which extends under housings 70 and which comprises electrical heating elements 174 immersed in a water bath 175 and controlled by the temperature probes 73. The steam 176 is admitted in the closed circuits through admission orifices 177 arranged in the upper part of housings 70 and can be equipped with adjustment valves to permit a different effect in successive housings 70.

Figure 6:
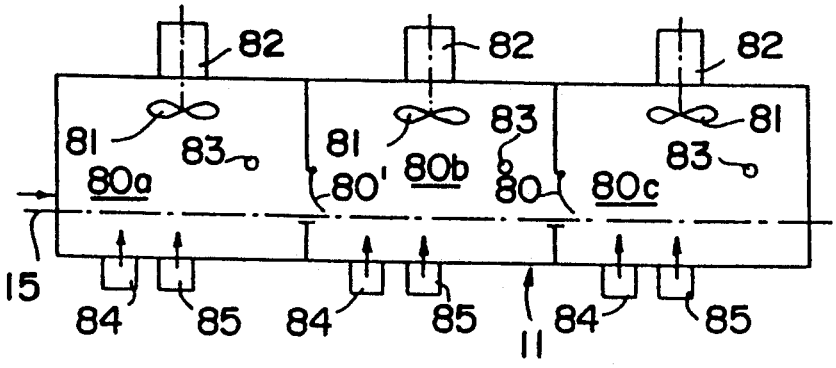

FIG. 6 illustrates an alternative embodiment of the upstream chamber 11 which implements substantially the same process as the alternatives illustrated by FIGS. 4 and 5 to impose a temperature gradient along the path of the thread and the conveyor belt 15. The chamber 11 is subdivided into several successive compartments 80*a*, 80*b* and 80*c*, by virtue of intermediate partitions comprising valves 80' for the passage of the thread. Each compartment is equipped with a ventilator 81 driven by a variable velocity motor 82 to ensure the mixing to the atmosphere in the compartment, a temperature probe 83, at least one steam injector 84 and at least one air injector 85. One can thus inject in a selective manner in each compartment, the steam and/or air in determined quantity and temperature, to separately adjust the temperature prevailing in each compartment. All these elements are connected to a centralized control ensuring the adjustment of the installation assembly.

Figure 7:
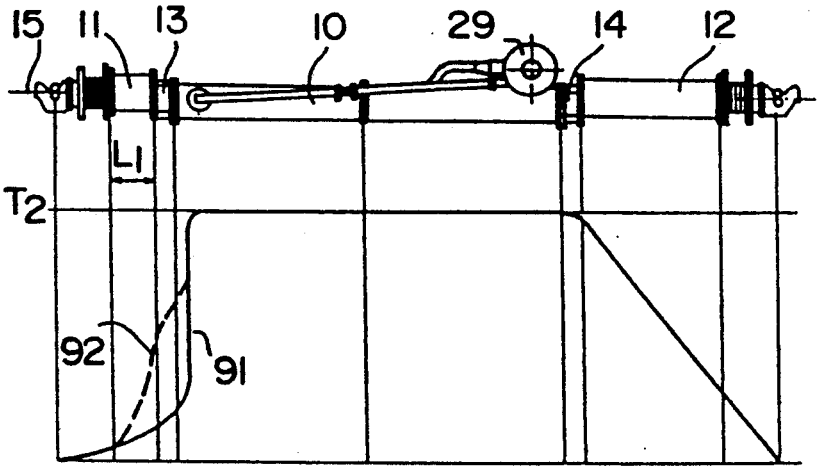
Figure 8:
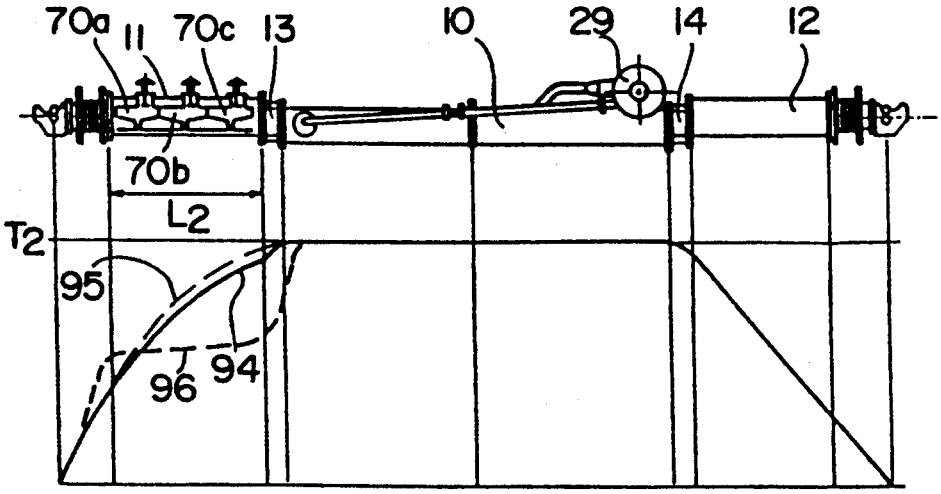

The diagrams of FIGS. 7 and 8 show typical curves of evolution of the thread temperature, in a conventional thermofixation installation and in an installation according to the invention, respectively, equipped with an upstream cold chamber of the type illustrated by FIGS. 4 and 5. In the two cases, the steaming chamber 10 is furnished with means 29 to mix the steam in the enclosure.

In the case of FIG. 7, the upstream cold chamber 11 has a relatively short length L1, on the order of 0.5 m. In normal operation, the temperature of the thread advances according to curve 91 drawn in a solid line, i.e. it remains low in the upstream cold chamber and it rises abruptly at the inlet of the steaming chamber 10. However, if the conveyor belt stops, the escapes of steam issuing from the chamber 10 cause an increase in the temperature in the upstream chamber 11 and in the intermediate chamber 13, according to curve 92, which has the disadvantages mentioned above.

On the other hand, the upstream cold chamber 11 of the installation shown in FIG. 8 has a greater length L2, for example approximately 2.0 m., and it encloses three heated air circuits going through housings 70*a*, 70*b* and 70*c*, respectively. The curve 94 indicates the temperature of the thread in continuous motion. The temperature in this chamber rises progressively and approaches an ideal curve 95 corresponding to a rise in temperature of the thread without any thermal shock up to the thermofixation temperature T2 in the chamber 10. In the case of stoppage of the belt, the three air circuits can be controlled so as to maintain graduated or equal temperatures in the housings, the thread then taking on a temperature according to curve 96, for example. One can also maintain lower temperatures, for example in the case of an extended stop of the belt, then implement a preheating before the restarting.

The different means described previously can be applied individually or in combination according to the results desired. The general idea consists of commanding the temperature and the circulation of air and steam in the successive zones of the thread path, especially to create a progressive elevation of the thread temperature so as to spare them a thermal shock, such that a stop of the machine no longer causes a different tinctorial affinity on the threads subjected to this stop.

Figure 9:
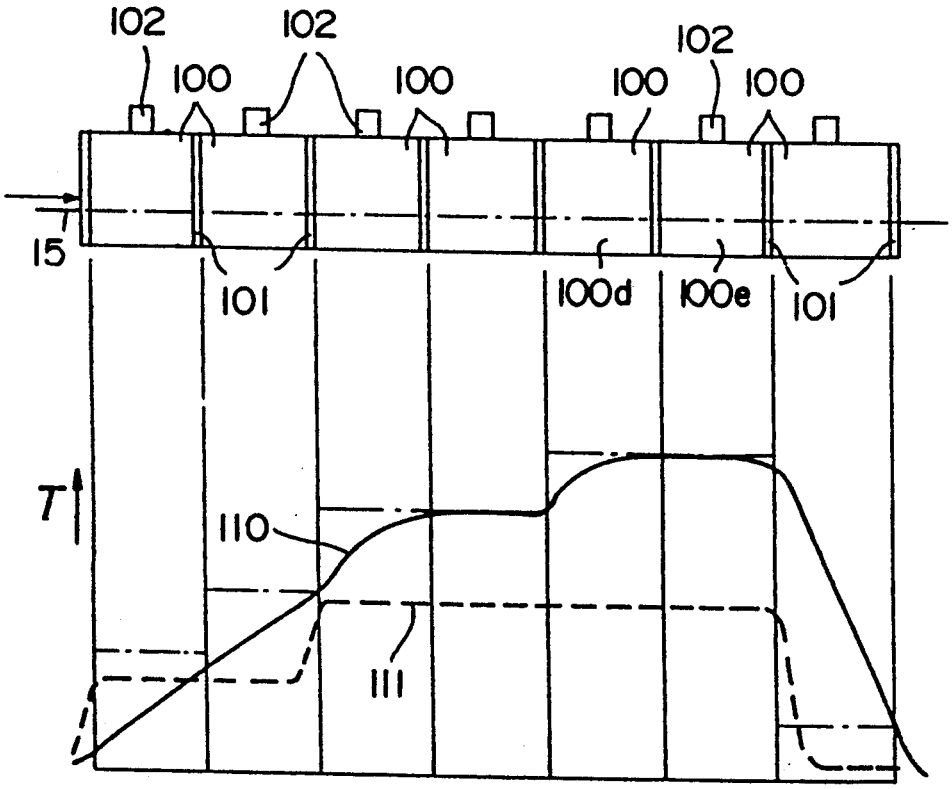

This general method is illustrated by FIG. 9 which shows schematically a modular installation formed of whatever number of units 100 juxtaposed along the path of the belt 15 transporting the threads. These units are connected to one another by junction elements 101 comprising at least one transverse partition and a passage for the threads and the belt, either in the form of a simple valve, or a lock chamber allowing the maintaining of a difference of pressure between the two chambers that it separates. Each unit 100 encloses a chamber equipped with elements for injection of steam and air, elements 102 to circulate these fluids in the chamber, and elements for measuring the temperature and possibly pressure. All of these elements are connected to a central control which is programmed to maintain the operating parameters which can be different in each chamber. These parameters include for example temperature, pressure, flow and temperature of injected steam, the flow and temperature of injected air, the rate of the fan. Of course, the velocity of the conveyor belt, the quality and quantity of the threads, as well as other parameters, are likewise taken into account to define the values of orders in the programmed control.

There is shown by way of example, in FIG. 9, the different temperatures T that can be obtained along the path of the threads in such an installation. The horizontal chain-dotted lines show the order values of the temperature in each unit 100 for a continuous operation. In this case, the temperature of the threads is shown by curve 110 in a solid line. In this example, the temperature is maximal only in two units 100*d* and 100*e* where pressurized steaming occurs. If for example the conveyor belt 15 must stop, the central control of the installation can pass to other order values and maintain, particularly in various chambers of units 100, different temperatures which maintain the threads at temperatures indicated by the curve 111 in broken lines. The control can likewise raise certain temperatures before putting the belt back into motion.

I claim:

1. Continuous heat treatment process for textile threads comprising:

passing threads that are deposited on a conveyor belt through an installation having several consecutive chambers which are adjacent each other, with at least one of said several consecutive chambers being a steaming chamber;

causing a gradual increase in temperature of the threads in at least one of an upstream or downstream location from said at least one steaming chamber by imposing a predetermined temperature gradient along at least one portion of the conveyor belt while maintaining in several consecutive chambers or in consecutive compartments arranged in at least one of said several consecutive chambers, temperatures which are different and gradually graduated, to thereby reduce thermal shock sustained by treads entering said at least one steaming chamber; and at least in a compartment preceding said at least one steaming chamber, withdrawing air from a top portion of a downstream zone of the compartment, and reinjecting the withdrawn air into a bottom portion of an upstream zone of the compartment.

2. Process according to claim 1, further comprising producing a positive temperature gradient in the direction of displacement of the conveyor belt, in an upstream cold chamber adjacent to an inlet of said at least one steaming chamber.

3. Process according to claim 2, wherein said upstream cold chamber is divided into several compartments crossed successively by the conveyor belt, and different temperature conditions are maintained in the several compartments.

4. Process according to claim 1, further comprising producing within said at least one steaming chamber a positive temperature gradient in the direction of displacement of the conveyor belt.

5. Process according to claim 4, wherein said positive temperature gradient is produced in said at least one steaming chamber by protecting threads arranged on the conveyor belt against a heat-conveying flow of steam, in an inlet zone of said at least one steaming chamber.

6. Process according to claim 1, wherein air taken from said top portion is heated or cooled by an exterior source before discharge into the bottom portion.

7. Process according to claim 6, wherein the air is heated by an input of steam or is cooled by an input of cool air.

8. Continuous heat treatment process for textile threads comprising:

passing threads that are deposited on a conveyor belt through an installation having several consecutive chambers which are adjacent each other, with at least one of said several consecutive chambers being a steaming chamber;

causing a gradual increase in temperature of the threads in at least one of an upstream or downstream location from said at least one steaming chamber, to thereby reduce thermal shock sustained by threads entering said at least one steaming chamber; and producing in said at least one steaming chamber a positive temperature gradient in a direction of displacement of said conveyor belt as it passes through said several consecutive chambers by reinjecting, in a central zone of said at least one steaming chamber, steam from a top portion of a downstream zone thereof, so as to cause mixing of the reinjected steam at least in a central zone of said at least one steaming chamber.

9. Continuous heat treatment installation for textile threads, comprising:

several consecutive chambers adjacent to one another, of which at least one of said several consecutive chambers comprises a steaming chamber;

at least one conveyor belt capable of supporting threads for passage through said several consecutive chambers;

means for creating a gradual increase in the temperature of threads at least one of an upstream or downstream location from said at least one steaming chamber, to thereby reduce thermal shock sustained by the threads entering the at least one steaming chamber;

two cold chambers, with each of said two cold chambers being arranged on one side of said at least one steaming chamber, and two intermediate chambers, with one of said two intermediate chambers being located between an upstream cold chamber and said at least one steaming chamber, and the other of said two intermediate chambers being located between said at one steaming chamber and a downstream cold chamber, and wherein the upstream cold chamber has a length at least equal to that of the downstream cold chamber; and a first conduit arranged to connect said two cold chambers, with said first conduit being connected to a second feeding conduit adapted to be connected to a source of pressurized air, said first conduit including a valve controlled by a first regulator connected to temperature probes arranged in said two intermediate chambers, and to a pressure probe arranged in said at least one streaming chamber.

10. Installation according to claim 9, wherein said first conduit opens into said upstream cold chamber within a compartment positioned farthest upstream of the passage of said conveyor belt.

11. Installation according to claim 9, wherein said at least one steaming chamber contains a temperature probe connected to a second regulator arranged to control a valve mounted on a steam feeding conduit of said at least one steaming chamber, and in that said first and second regulators are coupled between them.

12. Continuous heat treatment installation for textile threads, comprising:

several consecutive chambers adjacent to one another, of which at least one of said several consecutive chambers comprises a steaming chamber;

at least one conveyor belt capable of supporting threads for passage through said several consecutive chambers;

means for creating a gradual increase in the temperature of threads at least at one of an upstream or downstream location from said at least one steaming chamber, to thereby reduce thermal shock sustained by the threads entering the at least one steaming chamber;

two cold chambers, with each of said two cold chambers being arranged on one side of said at least one steaming chamber, and two intermediate chambers, with one of said two intermediate chambers being located between an upstream cold chamber and said at least one steaming chamber, and the other of said two intermediate chambers being located between said at one steaming chamber and a downstream cold chamber, and wherein the upstream cold chamber has a length at least equal to that of the downstream cold chamber; and said upstream cold chamber comprising at least two partitioned compartments, with the last compartment in the direction of passage of said conveyor belt including means for raising the temperature of surrounding air to a value greater than that of the other compartments, said means for raising the temperature comprising a suctioning element to suction air from a top portion of a downstream zone of said last compartment and to discharge the air into a bottom portion of an upstream zone of said last compartment, and a heating element to elevate the temperature of the air prior to its discharge into said bottom portion.

13. Continuous heat treatment installation for textile threads, comprising:

several consecutive chambers adjacent to one another, of which at least one of said several consecutive chambers comprises a steaming chamber;

at least one conveyor belt capable of supporting threads for passage through said several consecutive chambers;

means for creating a gradual increase in the temperature of threads at least at one of an upstream or downstream location from said at least one steaming chamber, to thereby reduce thermal shock sustained by the threads entering the at least one steaming chamber; and means for creating a gradient of temperature in said at least one steaming chamber comprising a suctioning element to suction steam from a top portion of a downstream zone of said at least one steaming chamber and discharge the steam into a bottom portion of a central zone thereof, and a heating element for elevating the temperature of the stream prior to discharge into said central zone.

14. Installation according to claim 13, further including, upstream from said at least one steaming chamber, an upstream cold chamber which includes at least two compartments arranged consecutively along the path of said conveyor belt and surrounding said conveyor belt, each compartment being equipped with means for circulating a current of air, or air and steam across said conveyor belt, and means for heating or cooling the circulating current, and control means for adjusting at least one of the temperature and the flow of the circulating current.

15. Installation according to claim 14, wherein each of said compartments comprises a housing incorporated in a respective closed circuit.

16. Installation according to claim 15, wherein the means for heating the circulating current comprise at least one heating element having electrical resistance arranged in said respective closed circuit.

17. Installation according to claim 15, wherein said upstream cold chamber contains a steam generating device positioned outside said housing, which includes orifices for admitting steam.

18. Installation according to claim 14, wherein said means for heating or cooling the circulating current comprise a means for injecting a measured quantity of steam or a measured quantity of cold air into the air current.

19. Installation according to claim 13, wherein said means for creating a gradient of temperature in said at least one steaming chamber comprises, in a zone near its inlet, a tunnel arranged on the path of the conveyor belt comprising walls forming a thermal screen for thread being transported on said conveyor belt.

20. Installation according to claim 13, comprising a modular series of consecutive units, each comprising a chamber furnished with mixing means for circulating at least one of air and steam in the chamber, and adjustment means for maintaining a predetermined temperature in the chamber.

21. Installation according to claim 20, further comprising a centralized control arranged to control said mixing means and said adjustment means.

22. Installation according to claim 20, wherein at least one of said units is arranged to contain pressurized steam.

* * * * *